US012221790B1

(12) United States Patent
Chambery

(10) Patent No.: US 12,221,790 B1
(45) **Date of Patent: *Feb. 11, 2025**

(54) DOWNSPOUT GUARD, KIT THEREFOR, AND METHOD OF ASSEMBLY

(71) Applicant: Brook Allen Chambery, Rochester, NY (US)

(72) Inventor: Brook Allen Chambery, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/110,003

(22) Filed: Feb. 15, 2023

Related U.S. Application Data

(63) Continuation-in-part of application No. 17/662,438, filed on May 9, 2022.

(60) Provisional application No. 63/232,262, filed on Aug. 12, 2021, provisional application No. 63/185,392, filed on May 7, 2021.

(51) Int. Cl.
*E04D 13/076* (2006.01)
*E04D 13/08* (2006.01)

(52) U.S. Cl.
CPC .... *E04D 13/0767* (2013.01); *E04D 2013/086* (2013.01)

(58) Field of Classification Search
CPC ..... E04D 2013/086; E04D 13/076; E04D 13/0767
See application file for complete search history.

(56) References Cited

U.S. PATENT DOCUMENTS 316,578 A 4/1885 Schumann et al.
571,711 A 11/1896 Twist
1,597,503 A * 8/1926 Andrews ..... E04D 13/076 52/12
2,175,138 A * 10/1939 Westlake, Jr. ..... E04D 13/076 52/12
2,532,388 A * 12/1950 Batt, Jr. ..... E04D 13/08 210/447
2,533,402 A 12/1950 Schmitz, Jr.
2,887,073 A * 5/1959 Thompson ..... E04D 13/08 52/12
3,956,133 A * 5/1976 Arnold ..... E04D 13/08 210/232
4,253,281 A * 3/1981 Ruttenberg ..... E04D 13/076 52/12
4,936,061 A * 6/1990 Palma ..... E04D 13/076 52/12
4,965,969 A * 10/1990 Antenen ..... E04D 13/076 52/12
5,040,750 A * 8/1991 Brant ..... E04D 13/0725 248/48.2
5,103,601 A * 4/1992 Hunt ..... E04D 13/076 52/12

(Continued)

*Primary Examiner* — Jessica L Laux
(74) *Attorney, Agent, or Firm* — Troutman Pepper Hamilton Sanders LLP

(57) ABSTRACT

A downspout guard having opposed sidewalls and opposed end walls connected to a top wall, all formed from material having openings therethrough, such as perforated metal. Bottom edges of the walls engage a gutter bottom wall to hold the guard in place and forcing water to flow through the guard before entering the downspout. The sidewalls can engage gutter front/back walls, further holding the guard in place. Trapped debris enhances further debris entrapment, even trapping particles smaller than the material openings.

8 Claims, 11 Drawing Sheets

(56) References Cited

U.S. PATENT DOCUMENTS 5,107,635 A * 4/1992 Carpenter ..... E04D 13/076 52/12
5,230,798 A * 7/1993 Rogman ..... B01D 29/96 52/12
5,242,591 A * 9/1993 Beechert ..... E04D 13/076 210/477
5,409,602 A * 4/1995 Sorenson ..... E04D 13/064 52/12
5,535,554 A * 7/1996 Harris, Jr. ..... E04D 13/0409 52/12
5,536,406 A * 7/1996 Silva ..... B01D 29/902 52/12
5,592,783 A * 1/1997 Jones ..... E04D 13/076 52/12
5,619,825 A * 4/1997 Leroney ..... E04D 13/076 52/12
5,882,508 A * 3/1999 St-Jacques ..... E04D 13/0645 210/170.03
RE36,343 E * 10/1999 Silva ..... B01D 29/33 52/12
5,960,590 A 10/1999 Hutchison
5,985,158 A * 11/1999 Tiderington ..... B01D 29/35 52/12
D425,182 S * 5/2000 Vargas ..... D23/260
6,075,074 A * 6/2000 Daly ..... B05D 1/025 523/333
6,114,414 A * 9/2000 Daly ..... B01J 2/006 523/333
6,193,880 B1 * 2/2001 Bergeron ..... E04D 13/0767 52/12
6,223,474 B1 * 5/2001 Kafton ..... E04D 13/076 52/12
6,293,054 B1 * 9/2001 Cangialosi ..... E04D 13/076 52/12
6,583,187 B1 * 6/2003 Daly ..... B29B 7/826 521/61
6,591,566 B1 * 7/2003 Rodlin ..... E04F 13/04 52/717.06
6,594,956 B1 * 7/2003 Willing ..... E04D 13/076 248/48.2
6,802,163 B2 * 10/2004 Hackman ..... E04F 13/04 52/311.1
D606,174 S * 12/2009 Martin ..... D23/261
7,919,002 B1 * 4/2011 Hurtado ..... E04D 13/08 210/170.03
8,646,217 B2 2/2014 Ratajac
8,656,647 B2 2/2014 Bath et al.
9,127,463 B1 * 9/2015 Feldhaus ..... E04D 13/076
9,388,559 B2 * 7/2016 Robertson ..... E04D 13/0767
9,416,543 B1 * 8/2016 Fox ..... E04D 13/0767
9,643,113 B2 * 5/2017 Farmer ..... E03C 1/264
10,519,667 B1 * 12/2019 Ealer, Sr. ..... B21D 47/005
2004/0006927 A1 * 1/2004 Wickett ..... E03F 3/046 52/12
2005/0016078 A1 * 1/2005 Rotter ..... E04D 13/08 52/12
2005/0034376 A1 2/2005 Pourdeyhimi et al.
2006/0191208 A1 * 8/2006 MacIntyre ..... E04D 13/0767 52/12
2006/0278573 A1 * 12/2006 Robinson ..... E04D 13/0767 52/12
2008/0229673 A1 * 9/2008 LaMorte ..... E04D 13/08 52/12
2013/0283707 A1 * 10/2013 Ratajac ..... E04D 13/076 52/12
2014/0115998 A1 * 5/2014 Horgan ..... E04D 13/08 52/741.1
2016/0040820 A1 * 2/2016 Morris ..... F16L 55/24 138/89
2017/0058530 A1 * 3/2017 Ward ..... E04D 13/0767
2020/0154887 A1 * 5/2020 Nilsson ..... A47B 45/00
2020/0254502 A1 * 8/2020 Hebert ..... B21D 31/04

* cited by examiner

DOWNSPOUT GUARD, KIT THEREFOR, AND METHOD OF ASSEMBLY

BACKGROUND

The invention relates generally to water runoff handling systems for buildings that include gutters and downspouts. More specifically, the invention relates to devices aiming to eliminate or at least significantly reduce entry of debris into downspouts of such systems, particularly in the context of roof gutter systems.

Various approaches to preventing debris from entering downspouts exist with the goal of avoiding clogging of downspouts and downstream hardware that can occur when debris is allowed to enter downspouts from gutters. Some of these are more successful than others, but all of them tend to allow too much debris to enter the downspout as they attempt to maintain drainage capacity and clog too easily, which can lead to water backup and overflow problems if the guards and the areas directly surrounding them are not constantly cleaned. While it is unlikely that maintenance or cleaning could be eliminated, a downspout guard is desirable that prevents even minute debris from entering the downspout, preserves water drainage capacity with even maximum buildup of debris, requires minimal cleaning of the gutter, is easy to install and remove when the gutter does need cleaning, is safe for hands and gutters, maintains functionality with a wide variety of downspout shapes and sizes, and is functional year round, including through ice and snow. Additionally, it is desirable to have such a guard available in a relatively compact, easy-to-assemble kit.

SUMMARY

Embodiments of the invention disclosed herein may include a downspout guard having five walls formed from at least one piece of material having openings therethrough. Embodiments further include two opposed sidewalls including a front sidewall and a back sidewall, two opposed end walls that provide filtration and drainage, and a top wall connected to the sidewalls and end walls and that provides drainage while providing filtration, wherein when installed in a gutter that includes opposed front and back walls connected to a bottom wall, bottom surfaces of at least the end walls engage the gutter bottom wall, and during operation, at least the two opposed end walls provide filtration to block passage of debris and smaller particles to form a filter cake.

Additionally, embodiments of the invention disclosed herein can include five walls formed from at least one piece of a material having openings therethrough and an open area ratio of at least 40%. The five walls can include two opposed sidewalls including a front sidewall and a back sidewall, two opposed end walls, and a top wall connected to the sidewalls and end walls. When installed in a gutter that includes a bottom wall, bottom surfaces of at least the end walls engage the gutter bottom wall.

Further, embodiments of the invention disclosed herein also contemplate a method of reducing debris flow to a downspout including providing opposed end walls, opposed sidewalls, and a top wall of a material having openings therethrough and an open area ratio of at least 40%. The method can further include connecting the end walls to the opposed sidewalls and the top wall to form a downspout guard with at least the opposed end walls primarily providing filtration and the top wall primarily providing drainage. The method can also include placing the downspout guard in a gutter over a downspout such that the downspout is under a center of the top wall and bottom edges of at least the opposed end walls engage a gutter bottom wall, thereby impeding progress of debris into the downspout while allowing water to proceed to the downspout. According to such a method, at least the end walls of the guard can collect particles during operation to form respective filter cakes that further enhance filtration.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings.

DETAILED DESCRIPTION

Figure 1:
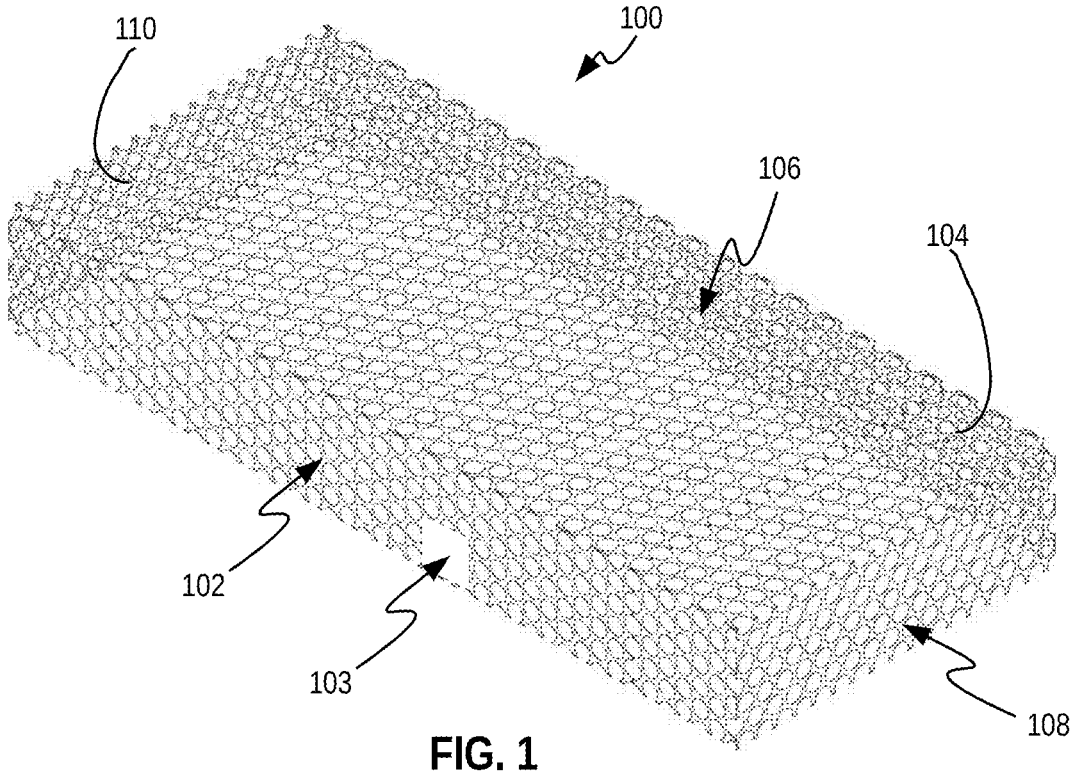
FIGS. 1, 10, and 14 are isometric views of examples of a downspout guard according to embodiments of the invention disclosed herein.
Figure 2:
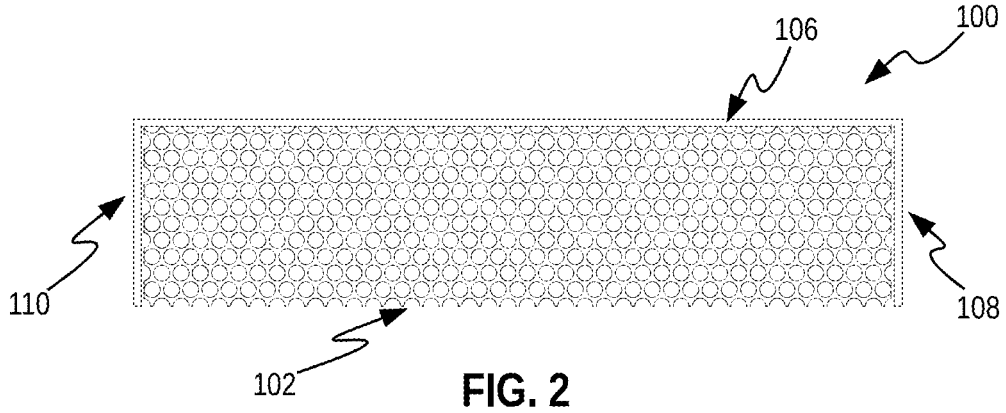
FIG. 2 is a side view of an example of a downspout guard according to embodiments of the invention disclosed herein.
Figure 3:
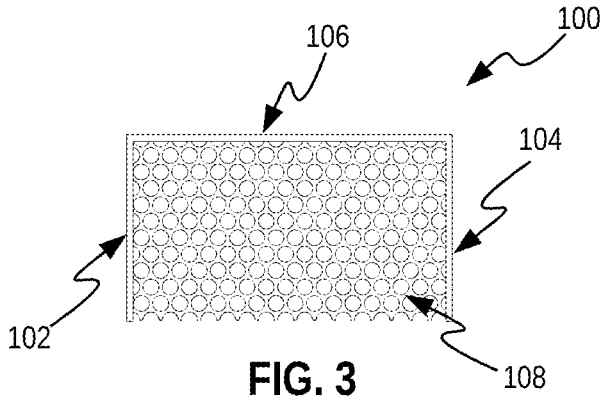
FIG. 3 is an end view of an example of a downspout guard according to embodiments of the invention disclosed herein.

Embodiments of the present invention are directed to a downspout guard that sits over an opening for a downspout in a gutter, methods of making such a guard, and a kit including pieces and/or components to form such a guard.

In addition to the FIGS. included herein, reference can be made to the drawings of the parent application, application Ser. No. 17/662,438, the disclosure of which is incorporated by reference, for additional views of a downspout guard. For example, FIGS. 7-18, 22, 23, 27, and 28 of the parent application show isometric and plan views of aspects embodiments of a downspout guard that may be of interest, and FIGS. 35-45 of the parent application show aspects of implementation and filter cake formation that may be of interest.

Preferably, the walls of the guard are made from a material including openings. For example, pieces of material with openings formed therein can be used to form embodiments. More particularly, pieces of plastic, metal, or other suitable materials can be used. Embodiments can, for example, be made from pieces of expanded material, such as expanded metal. However, embodiments can also be made from pieces of perforated material, such as perforated plastic, perforated metal, or other suitable materials including openings formed by perforation. While it is believed that any perforation shape can be used, round holes have been found to be advantageous and effective.

Previous embodiments using expanded metal mesh were found to be very effective in actual use. More recent experiments were conducted using perforated materials to form embodiments. As before, acceptable levels of performance were established as being able to handle the flow of water for which the gutters and downspouts are designed, and to trap minute amounts of debris which will then form filter cakes and aid in further filtration. As before, it was determined that an open area ratio of at least 60-65% was necessary to handle water flow requirements. It was also determined that in order to trap minute particles and form a filter cake, the diameter of the openings should be mor more than 0.2" with a center to center length or distance of no more than 0.25". The preferred perforation pattern chosen and validated in experiments consists of 60° staggered round holes (or openings) with a 5/32" (0.15625") diameter and a center to center length of 3/16" (0.1875"), which results in an open area ratio of 63%. It is also a very common, standard material manufactured by many perforated metal vendors, making it very easy and less expensive to obtain.

In other words, the finished guard preferably includes five sides or walls, with a horizontal top wall, vertical sidewalls, and vertical end walls. That is, the guard can have two opposed sidewalls connected to two opposed end walls and to a top wall to form a five-sided hollow polyhedron. Thus, in embodiments, two opposed sidewalls, two opposed end walls, and a top wall are all connected to form a five-sided hollow polyhedron.

While in embodiments, each wall can be made from a mesh material, such as a metal mesh or a plastic mesh, other embodiments can use any suitable material that has openings or holes that can allow passage of water, such as wire mesh or perforated materials, and can include any suitable base material, such as plastic, fiberglass, metal, or any other material with suitable properties. Examples of materials in which acceptable performance was observed include expanded metal mesh and perforated metal. Metal as a base material can be advantageous in embodiments for its durability and relatively high strength to weight ratio.

In addition, in embodiments, various walls, all of the walls, and/or portions of walls of embodiments can be made from a single piece of mesh material. For example, the opposed sidewalls and top wall can be formed from a single piece of material bent into a squared-off U-shape. In an additional example, the top wall can be one piece of mesh material, the side walls can each be part of a respective piece of mesh material, and the opposed end walls can be formed from respective pieces of mesh material. In a further example, all walls can be formed from a single piece of material cut to have the top wall in the center with the side and end walls projecting therefrom to be bent down to form the downspout guard of embodiments.

In some embodiments, to avoid possible obstructions such as downspout collars and caulking, at least one notch 103 (FIG. 1) can be formed in the bottom portion(s) of at least one sidewall, the end walls and sidewalls being of substantially equal height. In addition, embodiments can have one of the opposed sidewalls engaging at least part of the gutter front wall with the other of the opposed sidewalls engaging the gutter back wall, the opposed sidewalls thus holding the downspout guard in the gutter. In some embodiments, the guard can sit in the gutter with the sidewalls separated from the gutter front and back walls, in which case friction between the gutter bottom wall and bottoms of the guard sidewalls and end walls can hold the guard in place. Embodiments can also include an optional retainer to add positional security for the guard as will be described. Examples of optional retainers can include a shim or other object wedged between a wall of the guard and a wall of the gutter, various wire arrangements extending through portions of the guard and attached to the gutter, and even including flaps on end walls of the guard that can be bent to engage the gutter front and back walls to hold the guard in place. Embodiments can block dirt and debris from entering the downspout, which can greatly reduce the risk of any blockage further downstream, or in the downspout, which could otherwise create damming of water year-round, and ice problems in the winter. Thus, it can be very advantageous to leave the unit in place year-round.

In the five-walled guard of embodiments, all of the walls are important to the operation of the guard to maximize drainage while maximizing blockage of debris from passing into the downspout. The guard can be used with any shape downspout opening, can be used in a gutter with a snug or loose fit, can be held if necessary by wedging an object between it and the gutter, and in gutters with unusual shapes and/or where otherwise is difficult to ensure positional security of the guard, can be held with a retainer engaging the guard and part of the gutter. The guard can be particularly effective when the top wall area is at least twice that of the downspout opening, and when the side walls are about half the height of the gutter.

Figure 21:
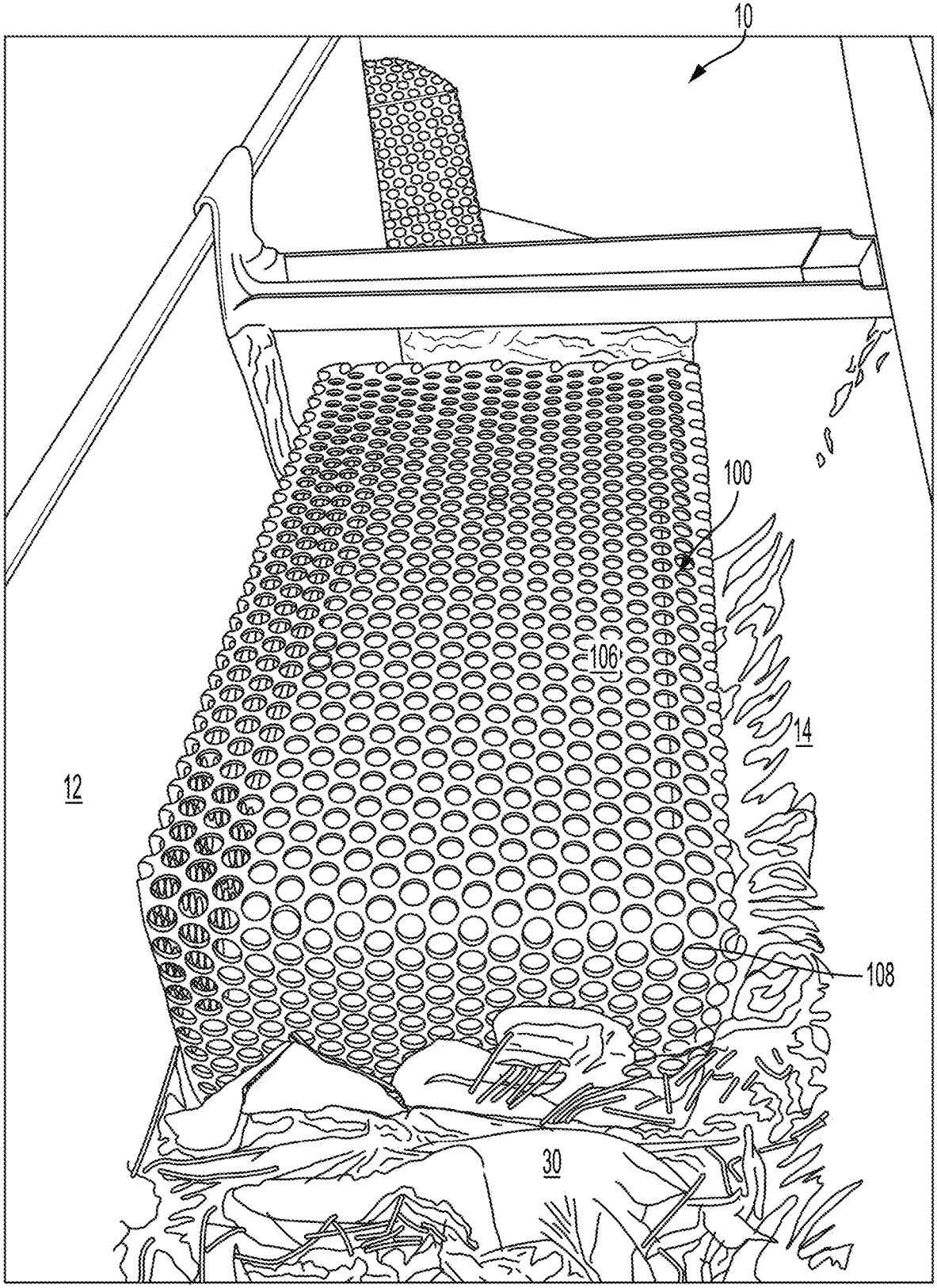
FIGS. 21-23 are black and white representations of photographs of an example of a downspout guard according to embodiments installed and in operation and illustrating filter cake formation.

The sidewalls and end walls primarily stop debris, whereas the top wall provides significant additional drainage area, particularly in times of heavy flow in the gutter, such as during heavy rain. That is, the end walls provide drainage and are responsible for filtration, including both large and minute particles, while the top wall provides filtration, primarily of larger debris, and augments and ensures maximum rate of flow and drainage capacity. In gutters where water and debris can reach the sidewalls, the sidewalls can also provide filtration and drainage. In other words, the sidewalls and end walls primarily provide filtration while secondarily providing drainage, and the top wall primarily provides drainage while secondarily providing filtration, such as when water level in the gutter in which the guard is installed exceeds the height of the guard. Such high water level can occur from buildup of material against the end walls and sidewalls and/or during extreme rainfall, for example. The unexpected and surprisingly effective results are particularly illustrated in FIGS. 21 and 23, with additional examples shown in FIGS. 34-49 of the U.S. patent application Ser. No. 17/662,438, filed May 9, 2022. The combination of the vertical orientation of the sidewalls and end walls and the use of a material with parameters as discussed above and elsewhere herein contribute to the inventive guard's filtration ability, blocking debris and particles smaller than the openings in the material and creating filter cakes.

More particularly, with reference to FIGS. 1-4, a downspout guard 100 according to embodiments can include opposed sidewalls, such as a front sidewall 102 and a back sidewall 104. Front and back sidewalls 102, 104 can be opposed to each other and spaced apart by a width of a top wall 106 connected to top edges of the front and back sidewalls 102, 104. Embodiments can also include opposed end walls, such as first end wall 108 and second end wall 110, disposed at opposite ends of top wall 106, as well as at opposite ends of front and back sidewalls 102, 104. In embodiments, opposed end walls 108, 110 can have a width equal to the width of top wall 106 and all of walls 102, 104, 108, 110 can have a same height, as seen in FIG. 1, for example. Preferably, the width of top wall 106 and thus guard 100 is selected to provide a slight interference fit between downspout guard 100 and front and back walls of a gutter into which guard 100 may be installed as will be described more fully below. Experiments have shown that if the material used to build guard 100 is heavy enough, even when sidewalls 102, 104 are separated from gutter front and back walls by a small gap, guard 100 can remain in place despite heavy rainfall. However, for lighter materials (such as aluminum), wider gaps, and simply for extra protection, additional positional security can be obtained for guard 100 through use of a shim or other object that can be wedged against guard 100 and at least one gutter wall, or by using a retainer or stay, such as the examples of retainers shown in FIGS. 15-20 and described below.

In embodiments, as indicated above, notches 103 can be formed in sidewalls 102, 104, enabling guard 100 can span obstructions, such as lips of the downspout, caulk, and/or structural or other features or objects in the gutter, such as gutter components or accessories, or a piece of material covering the downspout opening as discussed above.

Figure 4:
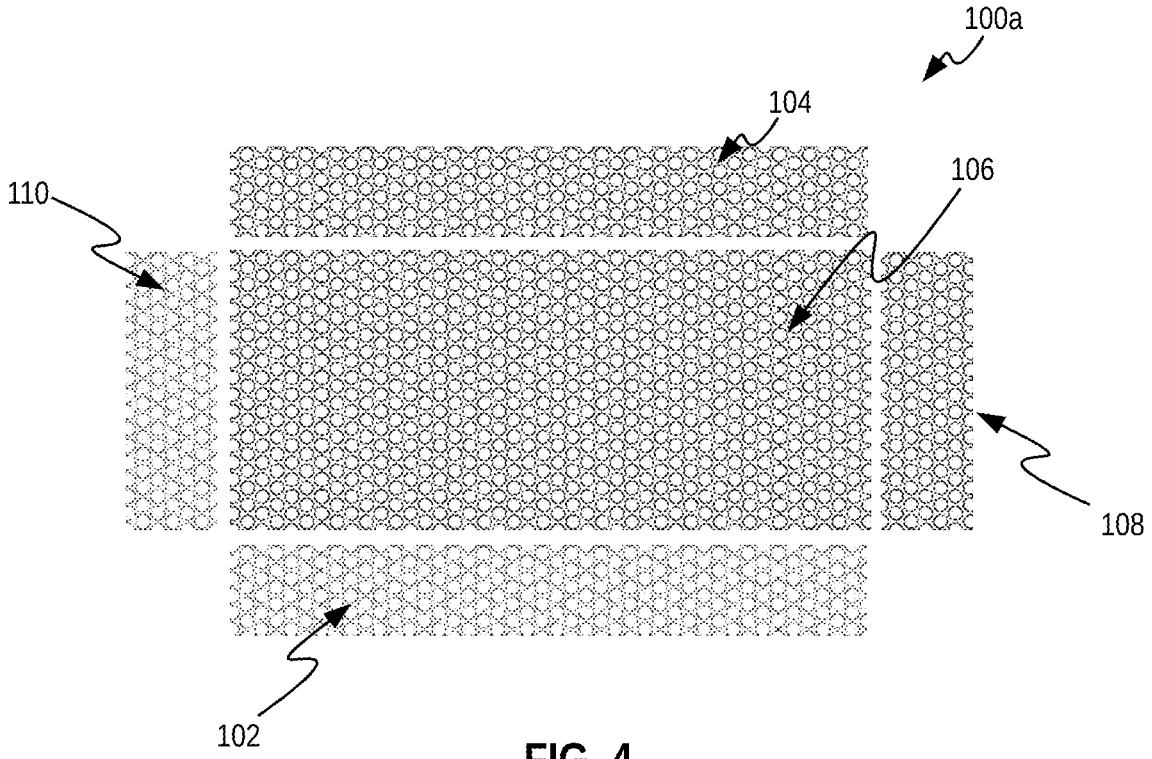
FIGS. 4, 5, 8, and 11 are plan views of examples of sheets of material or blanks from which embodiments of the invention disclosed herein can be formed.

As seen in FIG. 4, opposed sidewalls 102, 104, top wall 106, and end walls 108, 110 of embodiments can be formed from separate pieces as illustrated in arrangement 100*a* and in embodiments can be part of a kit an end user can use to assemble guard 100. The pieces can be placed in the desired configuration and connected by welding, adhesive, tabs extending from one or more walls of guard 100, mechanical fasteners, such as wire or plastic ties, or any other suitable methods. In embodiments, the pieces can be arranged with front and back sidewalls 102, 104 connected to and perpendicular to top wall 106 along longer edges of top wall 106, and first and second end walls 108, 110 connected to and perpendicular to top wall 106 along shorter edges of top wall 106.

Figure 5:
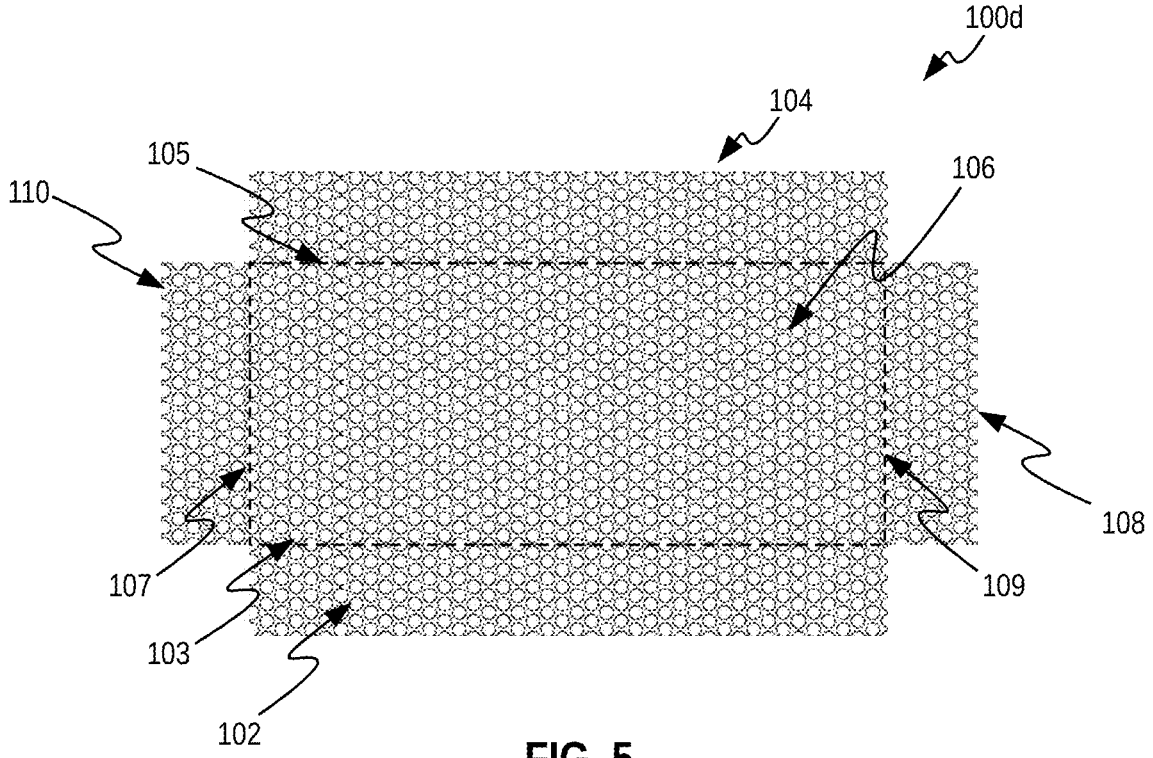

With reference to FIG. 5, embodiments can have all walls 102, 104, 106, 108, 110 formed from a single piece of material, illustrated as blank 100*d*. Sidewalls 102, 104 and end walls 108, 110 can subsequently be bent along fold lines 103, 105, 107, 109 to form downspout guard 100. In such embodiments, end walls 108, 110 can then be connected to sidewalls 102, 104 by tabs extending from at least one wall of guard 100, mechanical fasteners, such as wire or plastic ties, welding, adhesive, or any other suitable methods. The particular connection used can depend on the type of material used to make guard 100. In some such embodiments, if the mesh material is stiff enough and/or heavy enough, such connections between end walls 108, 110 and sidewalls 102, 104 are optional.

Figure 6:
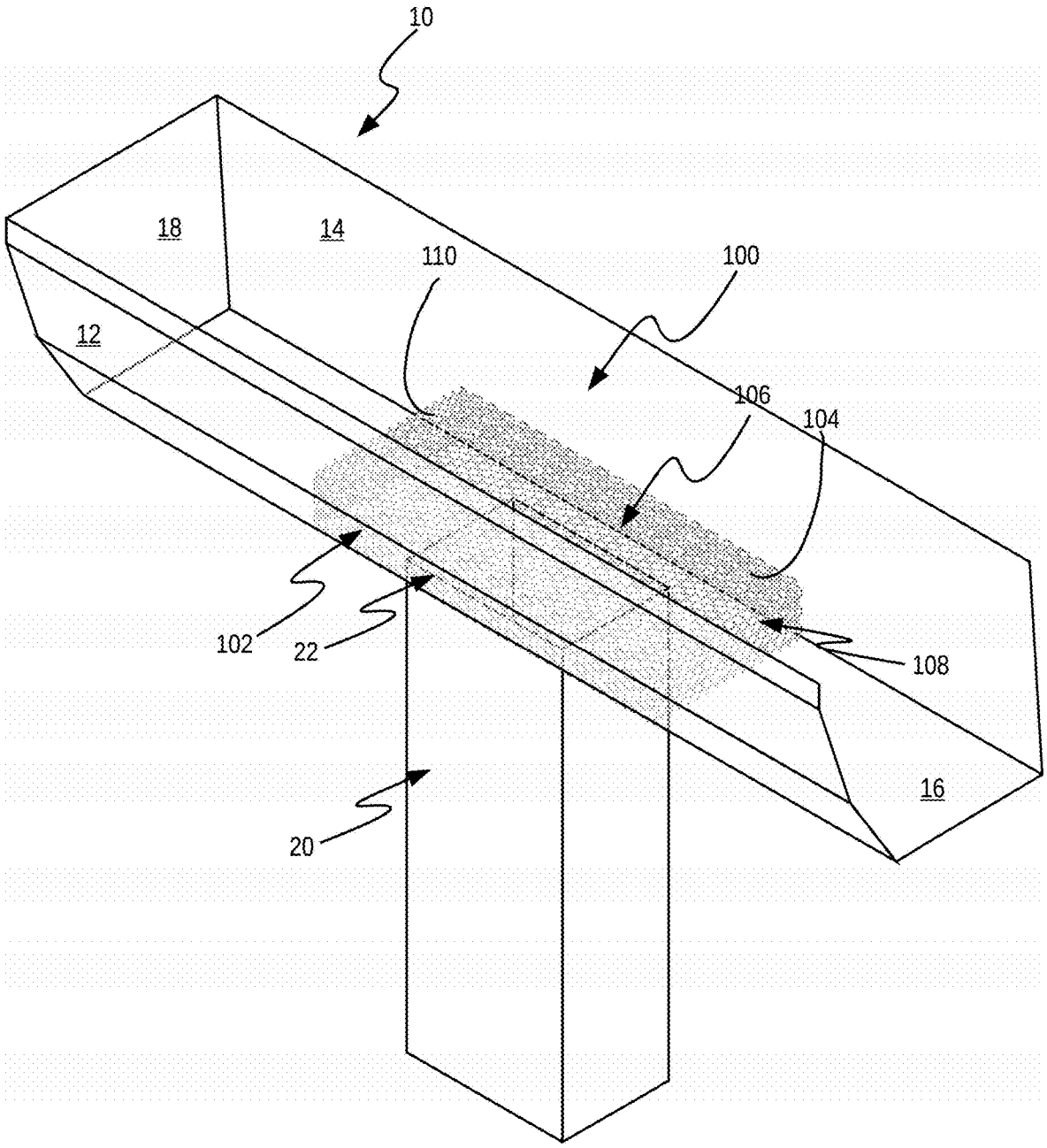
FIGS. 6 and 15 are isometric views of implementations of the examples of a downspout guard in a K-style gutter according to embodiments of the invention disclosed.
Figure 7:
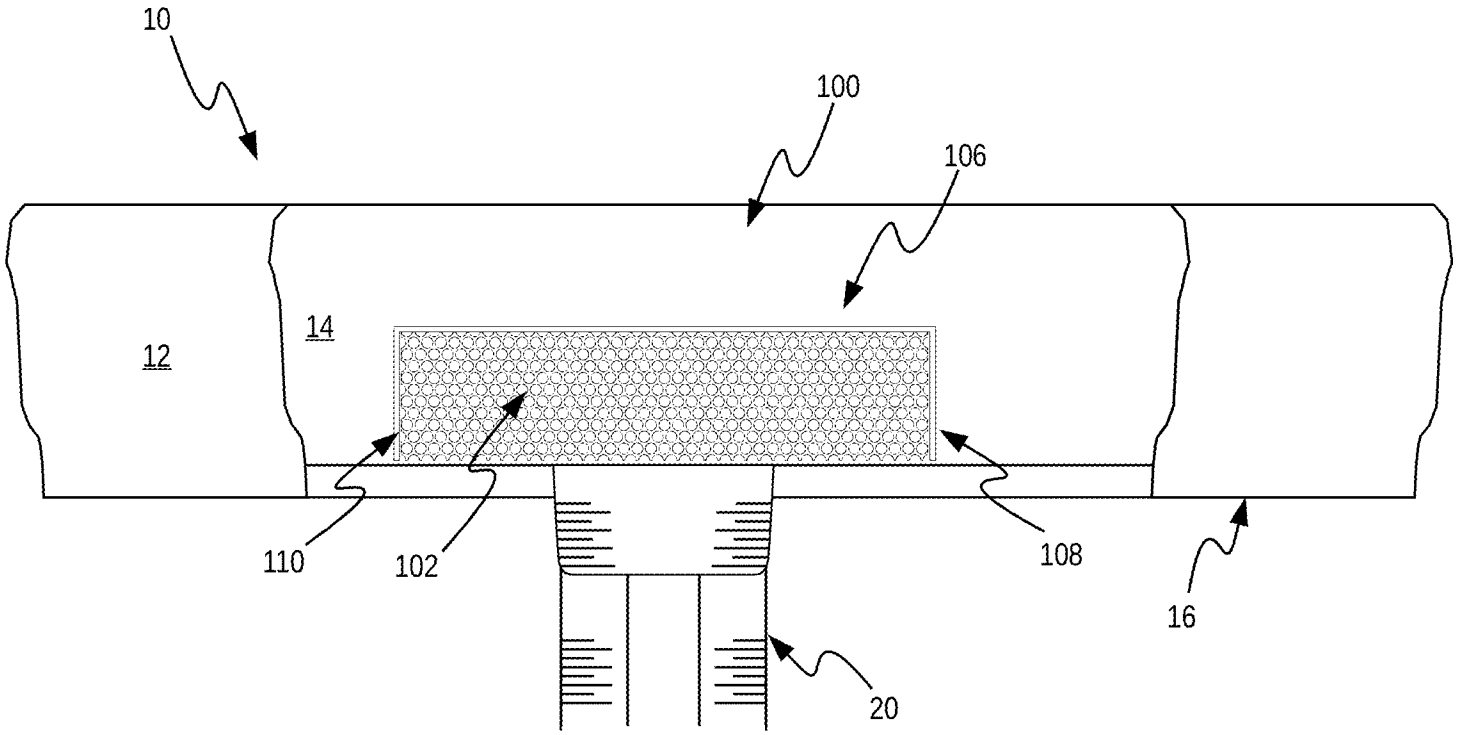
FIG. 7 is a side view of an implementation of a downspout guard according to embodiments of the invention disclosed herein.

Turning to FIGS. 6 and 7, an example of embodiments of the inventive downspout guard 100 is shown installed in a roof gutter 10 that includes a front wall 12, back wall 14, bottom wall 16, and end wall 18. A downspout 20 is attached to roof gutter 10, which includes downspout opening 22 in bottom wall 16 to allow passage of water into downspout 20. As with the embodiments shown above, such as in FIGS. 1-4, the shape of the downspout opening 22 is irrelevant, however, guard 100 can have better performance when an area of top wall 106 is at least twice that of downspout opening 22.

As shown, downspout guard 100 is preferably centered over downspout opening 22 with bottom edges of opposed sidewalls 102, 104 and opposed end walls 108, 110 resting on bottom wall 16. Preferably, opposed sidewalls 102, 104 at least partially engage respective front and back walls 12, 14. However, while it is preferred that sidewalls 102, 104 engage gutter front and back walls 12, 14, guard 100 is still effective with gaps therebetween and will remain substantially in position in even heavy flow through gutter 10. Because guard 100 does not rely on any downspout insert, downspout opening 22 can be round, oval, or rectangular shape. Guard 100 in embodiments is sized to more than cover any such shape and/or size downspout opening 22 may have. Preferably, for example, top wall 106 can have an area of at least twice the area of an opening of downspout opening 20. Since a downspout insert is not required for guard 100, flow restriction such an insert would induce can be avoided.

Figure 8:
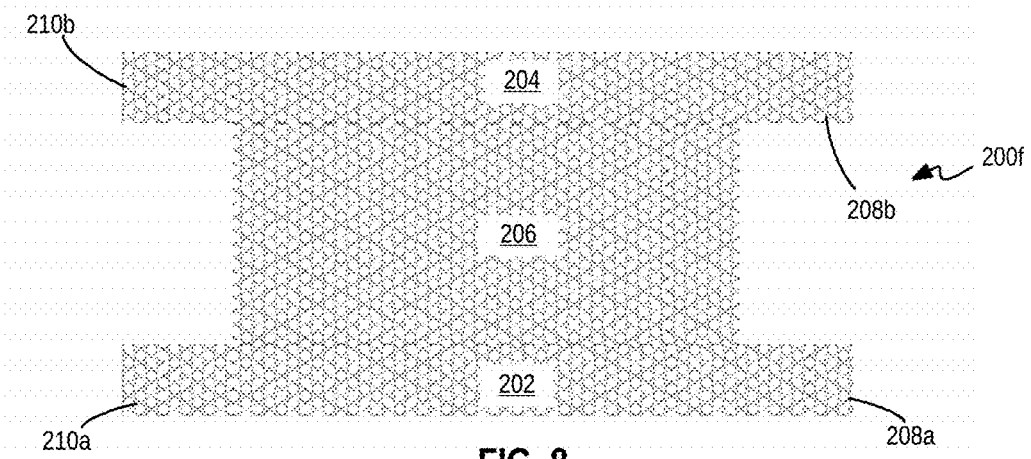
Figure 9:
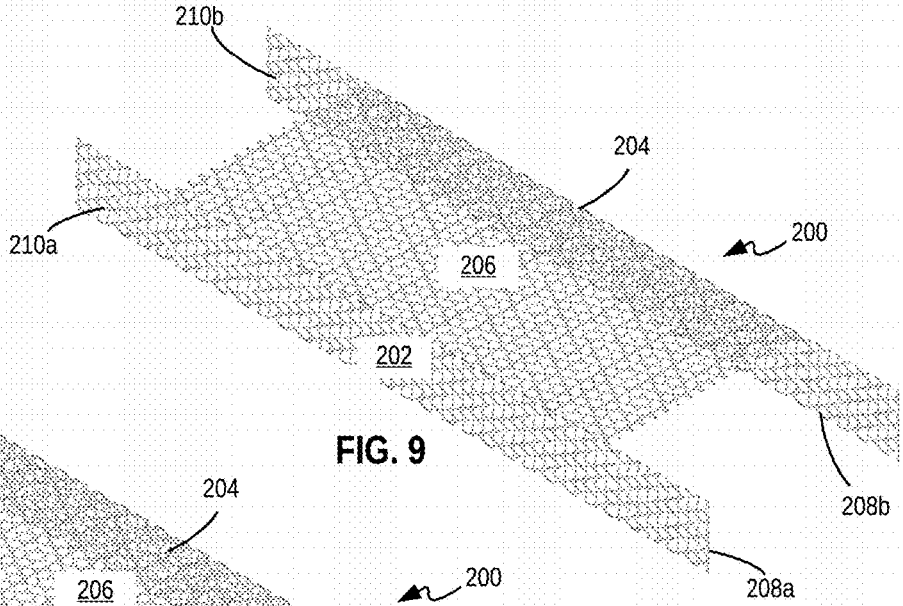
FIGS. 9, 12, and 13 are isometric views of stages of assembly of a downspout guard from the blanks shown in FIGS. 8 and 11 according to embodiments of the invention disclosed herein.
Figure 10:
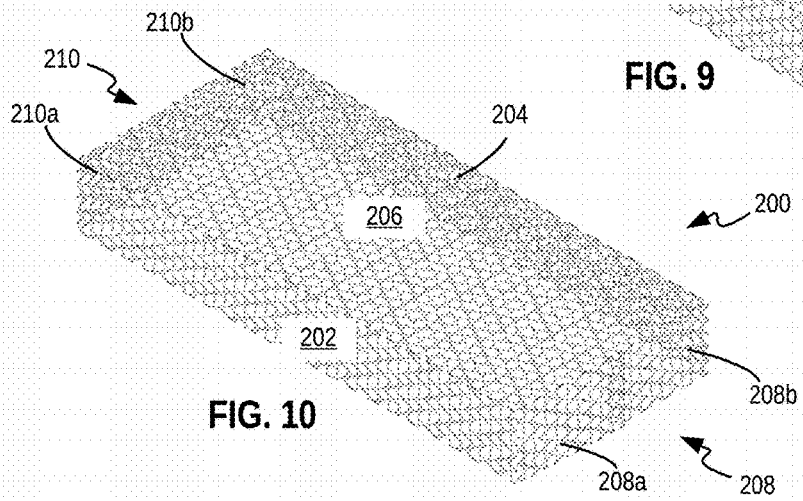

Another embodiment of guard 200 is shown in FIGS. 8-10 in which a single piece of material 200*f* includes top wall 206, sidewalls 202, 204, and opposed end wall tabs 208*a*, 208*b*, 210*a*, 210*b*. As shown in FIG. 8, the piece of material 200*f* can be bent to place front and back sidewalls 202, 204 in opposition to each other and to arrange the end wall tabs for assembly. End portions of opposed end wall tabs 208*a*, 208*b* can be superimposed and attached to each other and can also be attached to top wall 206. Likewise, as seen in FIG. 10, end portions of opposed end wall tabs 210*a*, 210*b* can be superimposed and attached to each other to form guard 200. Opposed end wall tabs 208*a*, 208*b* can also be attached to top wall 206.

To resist movement of downspout guard 100 from its position in roof gutter 10, a width of top wall 106 and opposed end walls 108, 110 is preferably selected so that opposed sidewalls 102, 104 provide at least a snug fit with front and back walls 12, 14 of roof gutter 10, but gaps between opposed sidewalls 102, 104 and front and back walls 12, 14 can be present as noted above, with the bottom edges of guard 100 holding the guard in place. Metal base material is preferred since it is typically sturdier, heavier (and thus more resistant to being dislodged by water and/or debris), and has a reduced risk of failure due to solarization as would be likely to occur with plastic base material. In experiments, a perforated material, such as perforated metal, was found to be very effective, the perforated material having an open area ratio of at least 60% derived from round staggered holes of 5/32" diameter with center pitch of 3/16".

Figure 11:
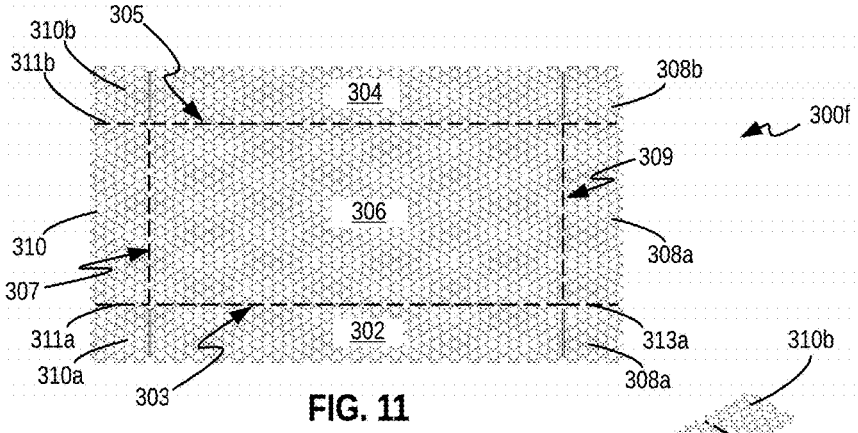
Figure 12:
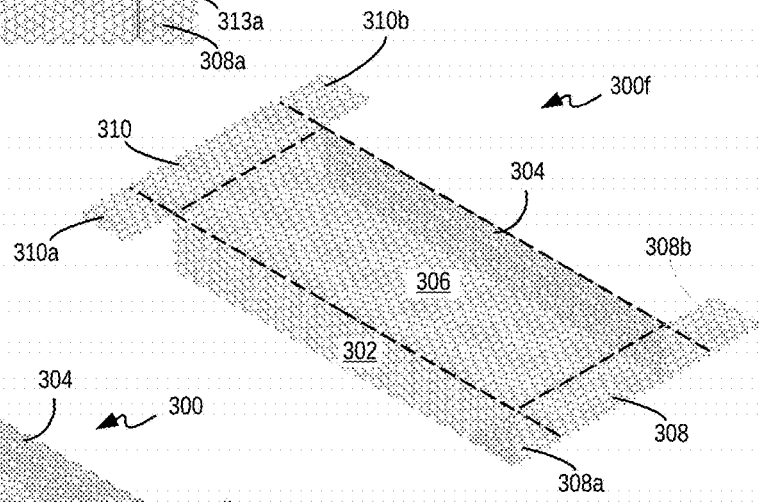
Figure 13:
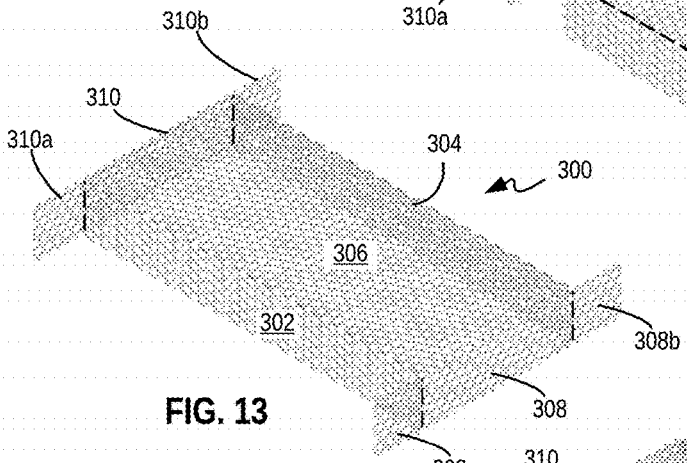
Figure 14:
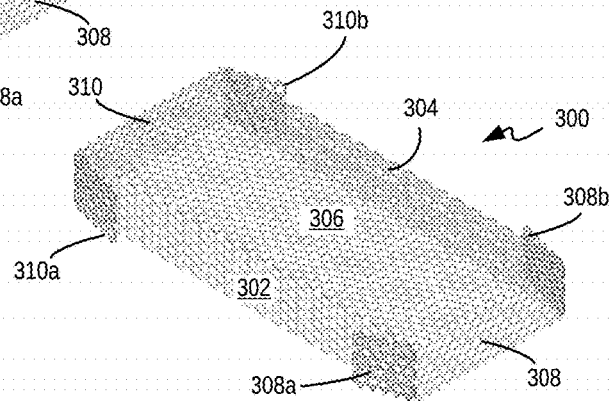

In embodiments, where additional positional security of guard 100 is desired, such as when a snug fit cannot be achieved with opposed sidewalls 102, 202, 104, 204 alone, embodiments such as that shown in FIGS. 11-14 can be employed. For example, additional positional security may be desired when using guard 100 in a gutter with a cross sectional shape other than a standard K gutter, such as a gutter with a rounded wall or other non-standard shape. As seen in FIGS. 11-14, a single piece of material 300*f* can include top wall 306, sidewalls 302, 304, and end wall flaps 308*a*, 308*b*, 310*a*, 310*b*. As shown in FIG. 12, the piece of material 300*f* can be bent along fold lines 303, 305 to place front and back sidewalls 302, 304 in opposition to each other. FIG. 13 shows that piece of material 300*f* can be bent along fold lines 307, 309 to place opposed end walls 308, 310 into position to form guard 300 with end wall flaps 308*a*, 308*b*, 310*a*, 310*b* arranged for adjustment. As with other embodiments, opposed end walls 308, 310 can be connected or attached to opposed sidewalls 302, 304 using any suitable means as disclosed above. As seen in FIG. 14, end wall flaps 308*a*, 308*b*, 310*a*, 310*b* can be bent toward respective adjacent sidewalls along fold lines 311*a*, 311*b*, 313*a*, 313*b* (FIG. 11). Guard 300 can then be installed in a gutter, and end wall flaps can engage one or both of front and back walls of the gutter to assist in retaining guard 300 in position in the gutter.

Figure 15:
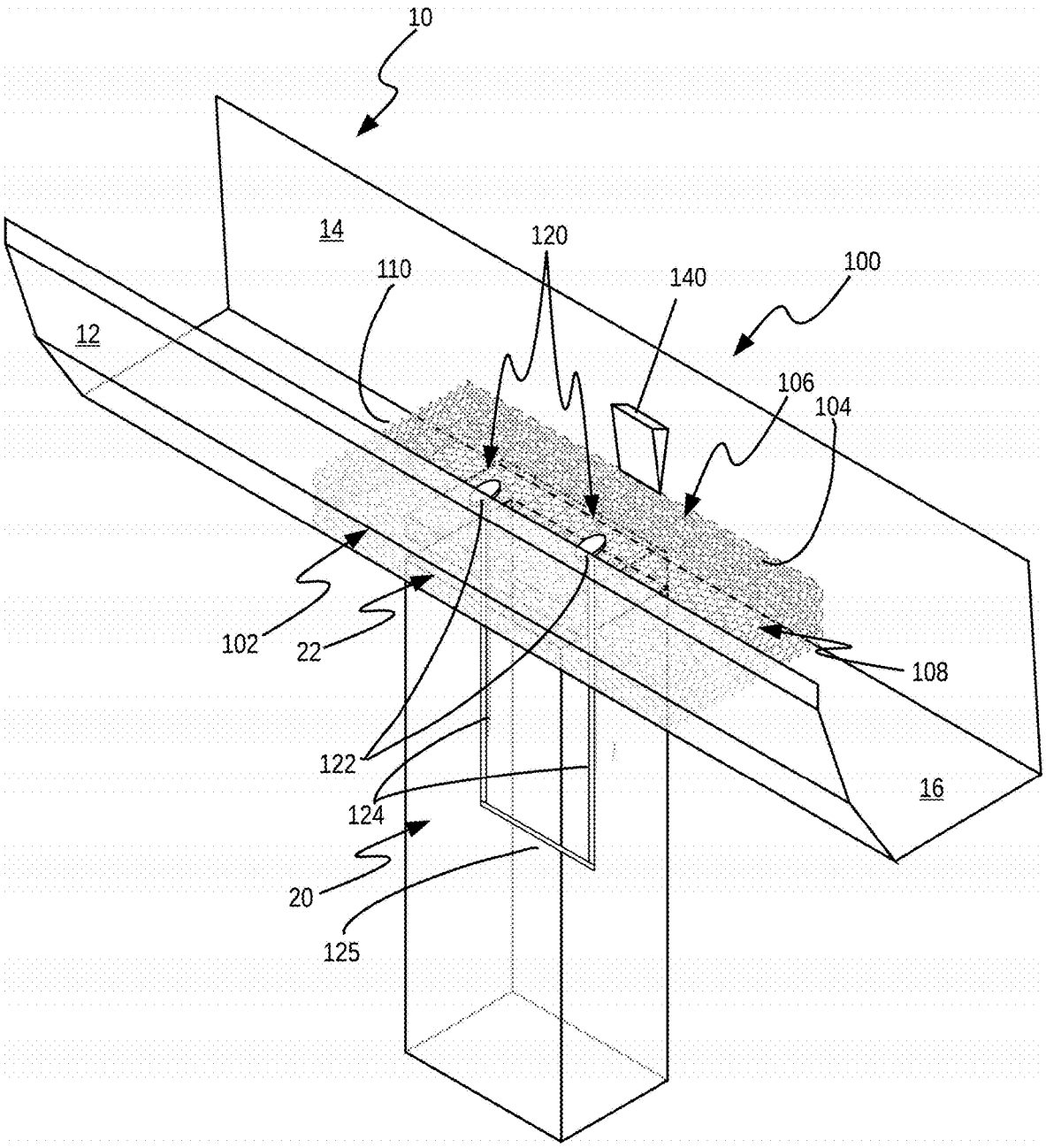
Figure 16:
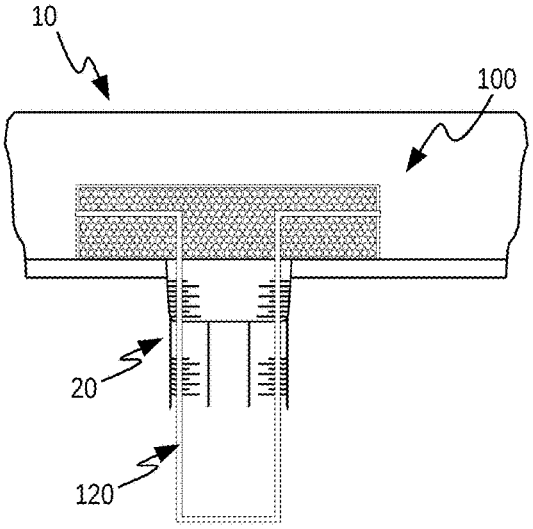
FIGS. 16-20 are side views of an implementation of a downspout guard according to embodiments disclosed herein and illustrating a variety of retainers that can be used therewith, also according to embodiments disclosed herein.
Figure 17:
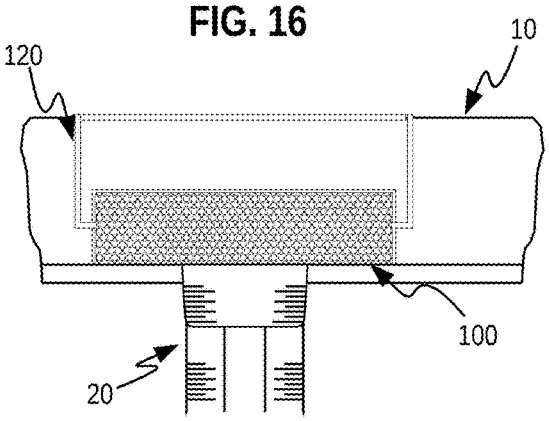
Figure 18:
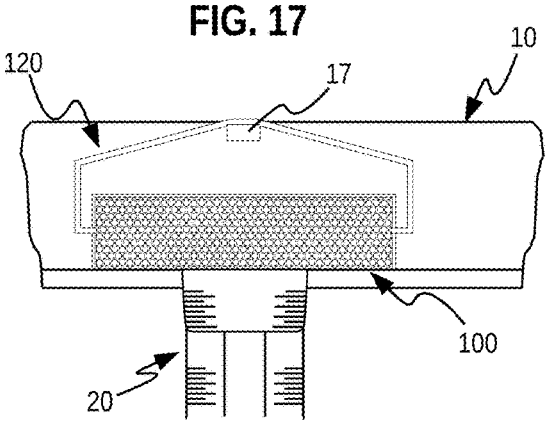
Figure 19:
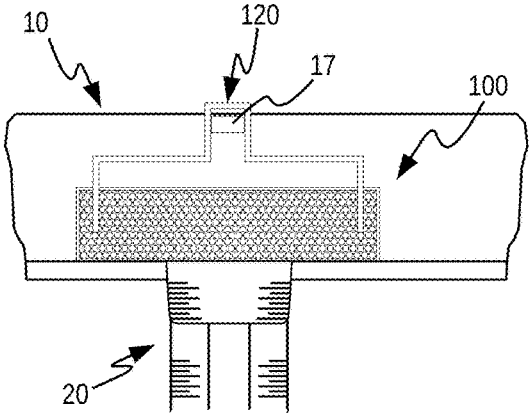

As seen in FIG. 15, instead of using end wall flaps as in the embodiments of FIGS. 11-14, a retainer can be employed to provide additional positional security. In FIG. 15, an example of such a retainer is shown in the form of connected pins 120 that can be inserted through top wall 106 so as to extend through downspout opening 22 into downspout 20. Each pin 120 can include a head 122 sized to rest on top wall 106, as well as a shaft 124 sized to fit through the mesh openings of top wall 106 and into downspout 20. While head 122 is shown, it should be noted that a hook or other means for preventing travel of shaft 124 and pin 210 as a whole can be used. Where two or more pins 120 are used, shafts 124 can be connected by a transverse member 125 at bottoms of shafts 124, forming a U-shape. While two pins 120 are shown, it should be understood that more or fewer pins 120 can be used as desired, suitable, and/or needed. Alternatively, the heads can be omitted and the retainer can be inverted so that ends of shafts 124 extend into downspout 20 and transverse member 125 rests on top wall 106. The retainer can be formed from a piece of wire or the like fashioned into a U shape so that shafts 124 form legs of the U inserted through top wall 106 of guard 100, such as about halfway between opposed end walls 108, 110, with connecting portion/transverse member 125 resting on top wall 106. In addition to or instead of pins or wire or the like, an object 140, such as a bushing or other object, can be inserted between a wall of guard 100 and a wall of the gutter to wedge guard 100 in place, thus acting as a retainer either on its own, with other such objects, with different objects, and/or with pins 120. Examples of objects 140 that can be used include, but are not limited to, bushings, washers, shims, and wedges.

It should be understood that fewer or more retainers could be used as desired, suitable, and/or needed. Likewise, while one object 140 is shown, more than one object 140 could be used and need not be of a same type. It should further be understood that other retainers could be employed, such as the examples shown in FIGS. 16-20. As seen in the FIGS., variations of retainer 120 can be used to secure guard 100, 200, 300 by insertion into downspout 20 (FIG. 16), insertion into a folded top edge of gutter 10 (FIG. 17), or by engaging a gutter hanger 17 (FIGS. 18-20), among other variations. It should also be noted that such retainers can be used with any embodiment of the downspout guard disclosed herein.

Figure 20:
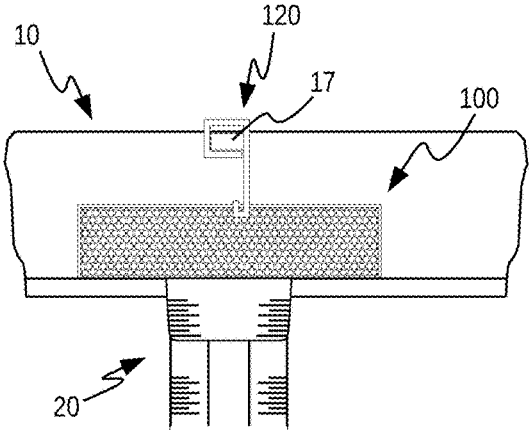
Figure 23:
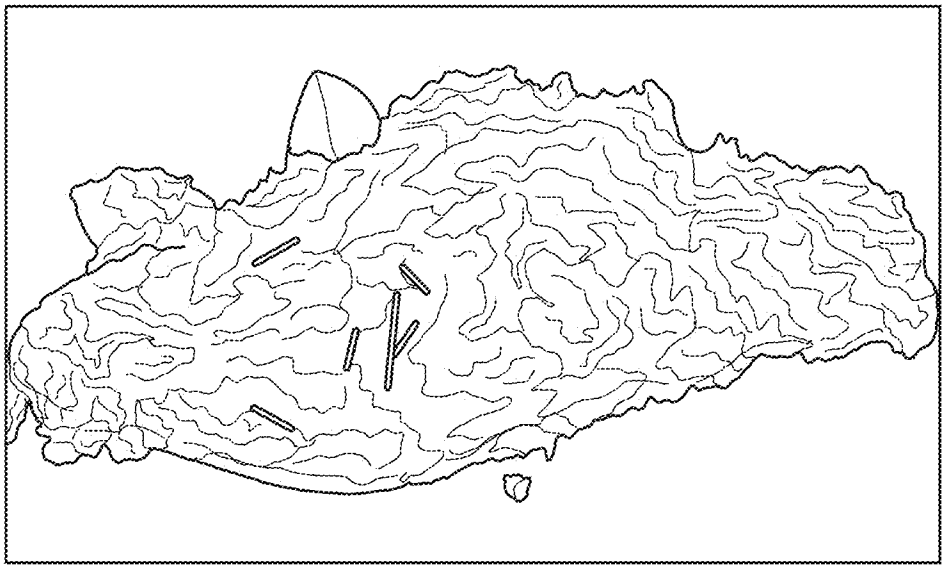
Figure 22:
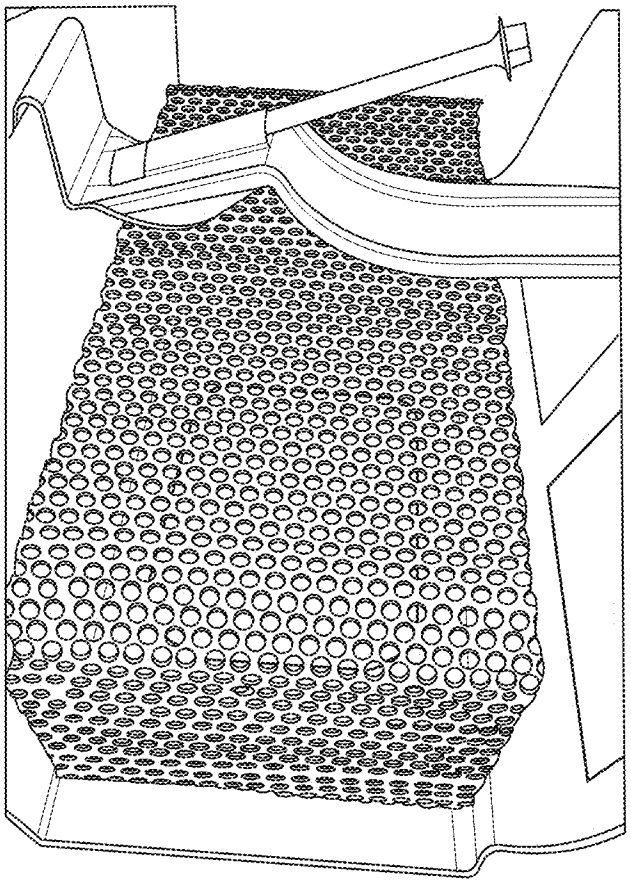
Figure 24:
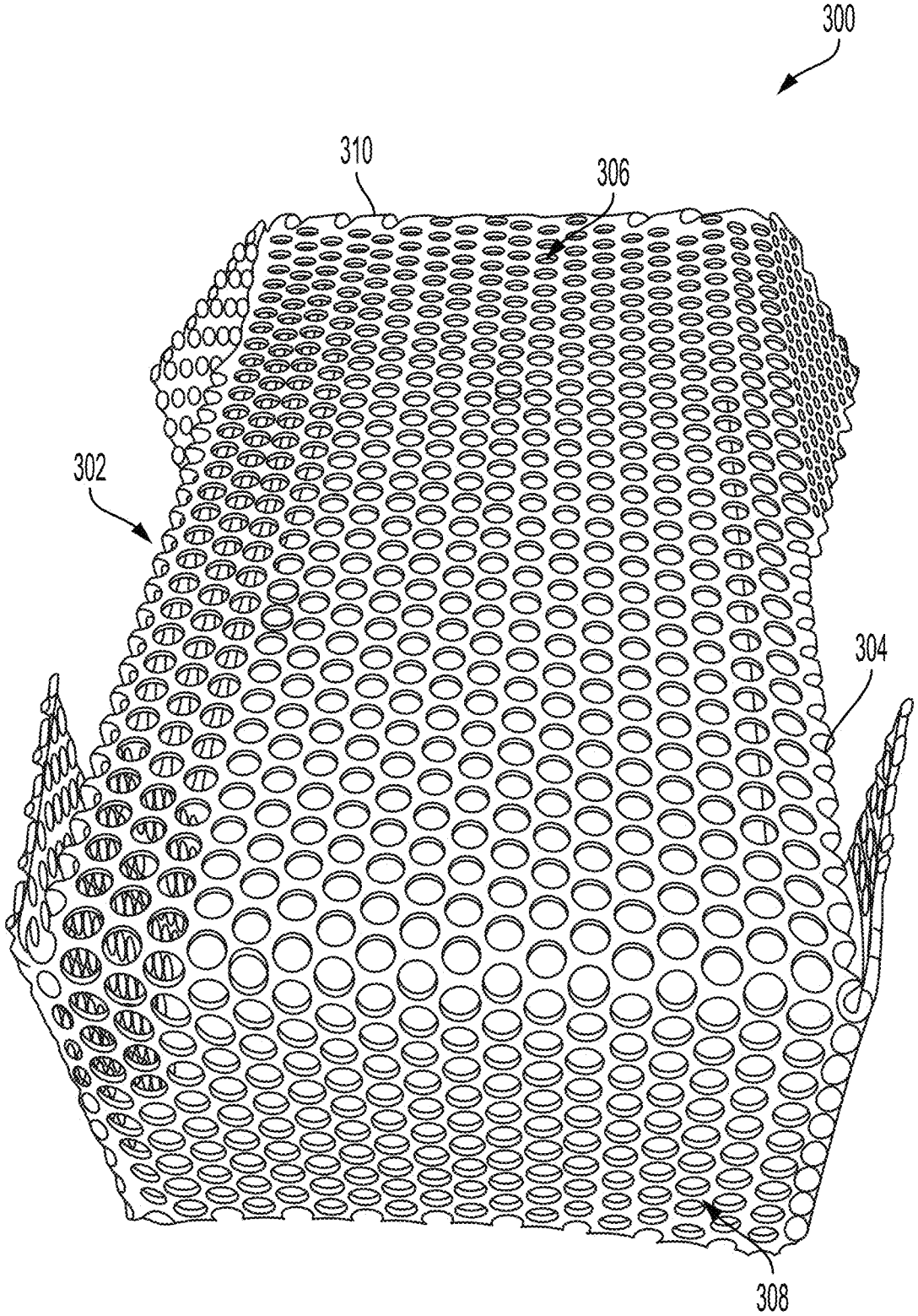
FIG. 24 is a black and white representation of an example of a downspout guard according to embodiments of the invention disclosed herein.

Debris piled against guard 100 can provide enhanced debris trapping and effectiveness as compared to that of prior art devices, as illustrated in FIGS. 20 and 23. More particularly, whereas prior art devices might filter or trap mainly large debris, embodiments of guard 100 can capture smaller debris, and even small particles or objects smaller than the openings in the walls of the guard. That is, the solid portions of guard 100, particularly of end walls 108, 110 and particularly with characteristics in the ranges described, can act as a pre-filter that can trap small organic and inorganic material particles that can lead to the formation of a porous filter cake, as illustrated in FIG. 23. This can enhance filtration, trapping roofing pebbles, seeds, particles as small as sand or soil particles, perhaps even smaller, such as spores, and preventing the trapped material from entering downspout 20. The filter cake (FIG. 23) can become quite thick while still allowing flowthrough of water. Whether or not a filter cake forms can depend on the composition and placement of material in the gutter as the rains comeP. For example, there may be a filter cake without any leaves, a filter cake followed by a pileup of leaves, or simply a pileup of leaves. The pileup of leaves and other debris can extend quite a distance from the guard end walls along the gutter, such as a couple of feet or more, and can rise higher than the guard, and at times, even atop guard 100 without preventing water from entering downspout 20.

In operation, end walls 108, 110, and, particularly in a K-style gutter, a portion of front sidewall 102 above where it engages gutter front wall 12 can be primary drainage areas, particularly during light to moderate rainfall. When flow through guard 100 is reduced by debris buildup against the primary drainage areas, or when rainfall is heavy, top wall 106 can provide significant additional drainage area. In experiments, the top wall rarely became clogged, for debris will back up quite far from guard 100 in gutter 10, and debris pileup against the end walls could rise higher than the tops of the end walls before accumulating on the top wall. Given the amount of debris that can accumulate before downspout effectiveness is compromised, cleaning frequency can be significantly reduced. In addition, it has been observed that downspout guard 100 can reduce ice formation in a downspout. It should be noted that a portion of back sidewall 104 can also provide filtration and drainage in embodiments and installations where water and debris can reach rear sidewall 104.

Particularly with regard to the embodiment of FIG. 5, embodiments contemplate a method of making a downspout guard 100 including providing a piece of a material, forming a blank 100*d* including portions for sidewalls 102, 104 and end walls 108, 110 extending from a portion for top wall 106, and bending the wall portions into position to form downspout guard 100. In embodiments using a perforated metal material, forming a blank can include stamping, cutting, and/or perforating and/or punching, though other techniques fall within the scope of embodiments. The method may additionally include performing a powder coating process in embodiments using metal material. Such a method is particularly suited to mass production of downspout guard 100 for sale in its final form.

Similar methods can be applied to produce other exemplary embodiments above and as shown and described in the parent of this application, the disclosure of which is incorporated by reference, as well as kits for an end user to complete formation of downspout guard 100. For example, with reference to FIG. 5, the method can include forming a blank 100*d* with portions for sidewalls 102, 104, and portions for end walls 108, 110. To complete assembly, the method can include bending blank 100*b* along fold lines 103, 105 into a U- or squared-off-U-shape, and attaching end walls 108, 110 to sidewalls 102, 104. The manner of attachment can include welding, adhesive, mechanical fasteners, such as wire or plastic ties, or any other suitable methods. As above, in embodiments using metal materials, the method can include performing a powder coating process.

With reference to FIG. 4, the method can include forming separate pieces of material for opposed sidewalls 102, 104, top wall 106, and end walls 108, 110 as illustrated in arrangement 100*a*, placing tops of front and back sidewalls 102, 104 adjacent and perpendicular to top wall 106 along longer edges of top wall 106, placing tops of first and second end walls 108, 110 adjacent and perpendicular to top wall 106 along shorter edges of top wall 106, and connecting the pieces to form downspout guard 100. For example, the pieces can be connected by mechanical, such as wire or plastic ties, tabs extending from one or more walls, welding, adhesive, or any other suitable methods. Where a kit is desired, the method can include packaging the pieces and arranging and connecting can be left to the end user. In embodiments using metal material, the method can include performing a powder coating process, which should be performed after connecting unless a kit is formed, in which case it should be performed after forming the pieces but before packaging the pieces. In embodiments using a plastic material, forming a blank can include cutting or melting or other suitable processes. As with embodiments above using metal, the method can preferably include fastening or connecting adjacent walls to each other after bending. Preferably, embodiments include ensuring the material has an open area ratio of at least 40%, preferably at least 50%, and even more preferably at least 60%.

Embodiments as described herein thus provide a downspout guard that can prevent even minute debris from entering the downspout, allow a larger buildup of debris without diminishing water drainage capacity, requires fewer instances of cleaning the guard and the gutter, is easy to install and remove when it does need cleaning, is safe for hands and gutters, and is adjustable to ensure a tight fit.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A downspout guard comprising:

a housing consisting of five walls formed from one single piece of a perforated material having openings therethrough with an open area ratio between 60% to 65%, wherein the five walls each extend and are formed to be uninterrupted from edge to edge of each of the walls and consist of:

two opposed sidewalls consisting of a front sidewall and a back sidewall;

two opposed end walls that provide filtration and drainage; and a top wall connected to the sidewalls and the end walls with each of the sidewalls and the end walls continuously extending perpendicularly from the top wall and that provides drainage while providing filtration, wherein a space between the two opposed side walls and the two opposed end walls and extending away from the top wall is completely open and when installed in a gutter that includes opposed front and back walls connected to a bottom wall, bottom surfaces of at least the end walls engage the gutter bottom wall of the gutter, and during operation, at least the two opposed end walls configured with the openings therethrough with the open area ratio between 60% to 65% and the perpendicular extension from the top wall that provide filtration to block passage of debris and particles smaller than any of the openings in the material to form a filter cake.

2. The downspout guard of claim 1, wherein when installed in a gutter that includes opposed front and back walls connected to a bottom wall, the front and back sidewalls of the downspout guard engage the respective front and back walls of the gutter.

3. The downspout guard of claim 1, wherein the openings have a center-to-center distance of no more than 0.25".

4. The downspout guard of claim 1, wherein the openings have 60° staggered centers.

5. The downspout guard of claim 4, wherein the openings have a width of no more than 0.2".

6. The downspout guard of claim 1, wherein the material includes a metal.

7. The downspout guard of claim 1, wherein the openings have a width of no more than 0.2".

8. The downspout guard of claim 1, wherein the material of at least the opposed end walls includes the openings having a width of no more than 0.2".

* * * * *